US009764450B2

(12) United States Patent
Norris

(10) Patent No.: US 9,764,450 B2
(45) Date of Patent: Sep. 19, 2017

(54) TURN HANDLE ADJUSTABLE WRENCH

(71) Applicant: Terrance Anthony Norris, Wyandanch, NY (US)

(72) Inventor: Terrance Anthony Norris, Wyandanch, NY (US)

(73) Assignee: Terrance A. Norris, Wyandanch, NY (US)

( * ) Notice: Subject to any disclaimer, the term of this patent is extended or adjusted under 35 U.S.C. 154(b) by 276 days.

(21) Appl. No.: 14/704,741

(22) Filed: May 5, 2015

(65) Prior Publication Data

US 2016/0325408 A1 Nov. 10, 2016

(51) Int. Cl.
*B25B 13/16* (2006.01)
*B25B 13/14* (2006.01)
*B25B 13/12* (2006.01)

(52) U.S. Cl.
CPC ..... *B25B 13/14* (2013.01); *B25B 13/12* (2013.01)

(58) Field of Classification Search
CPC ..... B25B 13/14; B25B 13/12; B25B 13/16
See application file for complete search history.

(56) References Cited

U.S. PATENT DOCUMENTS 784,243 A * 3/1905 Whaley ..... B25B 13/14 81/133
1,309,860 A * 7/1919 Kleine ..... B25B 13/14 81/165
1,371,649 A * 3/1921 Snyder ..... B25B 13/16 81/159
1,886,907 A * 11/1932 Rugger ..... B25B 13/14 81/163
2,646,710 A * 7/1953 Allen ..... B25B 13/14 81/165
2,708,386 A * 5/1955 Ellis, Jr. ..... B25B 13/14 81/165
4,156,368 A * 5/1979 Jackson ..... B25B 13/12 74/89.45
4,570,515 A * 2/1986 Yang ..... B25B 13/14 81/166
D367,412 S * 2/1996 Baldwin ..... D8/22
5,682,802 A * 11/1997 Mazzone ..... B25B 13/14 81/127

* cited by examiner

*Primary Examiner* — Bryan R Muller

(57) ABSTRACT

An adjustable wrench having a first fixed jaw; a handle extending away from the head and having a longitudinal axis; a second jaw selectively positionable with respect to the first jaw; a rotating rod controlling the positioning of said second jaw and comprising two rotating sleeves; one near the head located in the cut out of the handle; one near the rear located in the cut out of the handle; an end knob on the end opposite the gear train operatively coupling said rod to said second jaw; said rod having 3 holes for split drift pins to secure rotating sleeves and end rotating knob; said rod has a smaller diameter at a specified distance from the rod's end to accept a pin. At the rod's end is an end knob. Said sleeves and end knob rotate, at a latitudinal axis (perpendicular) to handle secured by split drift pins or adhesive. Such a wrench may have a p roof torque of at least the minimum level set forth in ASME B107.8 2003 revision.

12 Claims, 5 Drawing Sheets

TURN HANDLE ADJUSTABLE WRENCH

BACKGROUND OF THE INVENTION

The present invention is directed generally to hand tools known as adjustable wrenches, and more particularly to an adjustable wrench that has a rotating rod with rotating sleeve(s) or end knob.

Conventional wrenches include a fixed jaw and a moveable jaw, with movement of the moveable jaw controlled by an accessible adjusting worm gear. The user simply rotates the worm gear, typically by engaging the knurled outer surface thereof with their thumb, to move the moveable jaw toward or away from the fixed jaw. Alternatives approaches to adjustable wrenches have been proposed. For example, US Pat. No. 20070125205 A1 discloses an adjustable wrench with a slide based adjusting mechanism to control the movement of the moveable jaw. As convenient as this design is there is a need for a new design. One with the convenience of turning on the handle.

SUMMARY OF THE INVENTION

An adjustable wrench, comprising; a head having a first fixed jaw; a handle extending away from the head and having longitudinal axis; a second jaw selectively positionable with respect to the first jaw; a rotating rod controlling the positioning of the second jaw and comprising rotating sleeves; one near the head located in the cut out of the handle; one near the rear located in the cut out of the handle; an end knob on the end opposite the gear train operatively coupling the rod to the second jaw. The rod may have 3 holes for split drift pins to secure rotating sleeves and end rotating knob. The rod may have a smaller diameter at a specified distance from the rod's end to accept a pin or clip. The sleeves and end knob may rotate relative to the handle and be rotatably secured to the rod by split drift pins, adhesive or any other securing fashion known to the art. The sleeve(s) can be disposed between the rods' end and the gear train. The gear train comprises a rotatable worm gear operatively disposed between the rod and the second jaw. A biasing member may bias the worm gear toward the rod, and the biasing member may comprise a discrete spring. A retaining cap may be disposed as to constrain axial movement of the worm gear. The first jaw may extend in a fixed direction generally opposite the handle. with the head further comprising a pair of spaced, generally parallel, sidewalls distal from the first jaw with a recess defined between the sidewalls; wherein the gear train comprises a worm gear disposed substantially within the recess and having a rotational axis; the recess having a cross-sectional dimension E measured in a direction X that is both normal to the rotational axis and generally perpendicular to said first direction; wherein the sidewalls have a thickness in direction X of about 25% or more. The rod may have a knob on the end of the rod held securely by a split drift pin, adhesive or any other securing fashion known to the art. A wrench with these features may have a proof torque of at least the minimum level set forth in ASME B107.8, 2003 revision, when tested according to the method set forth in the ASME standard.

DETAILED DESCRIPTION OF THE INVENTION

Figure 1:
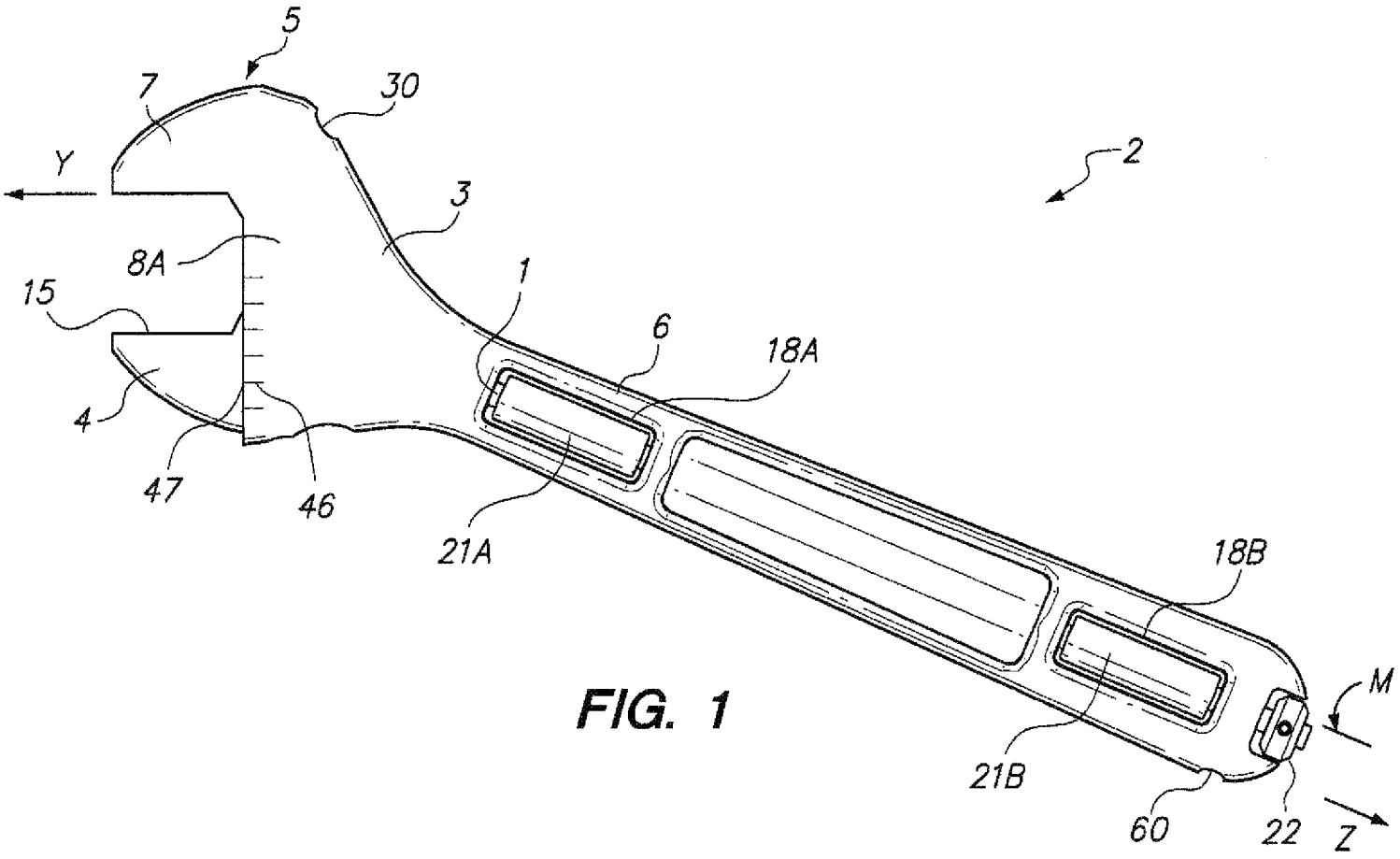
FIG. 1 shows an adjustable wrench constructed in accordance with the present invention with the jaws in an open position.
Figure 2:
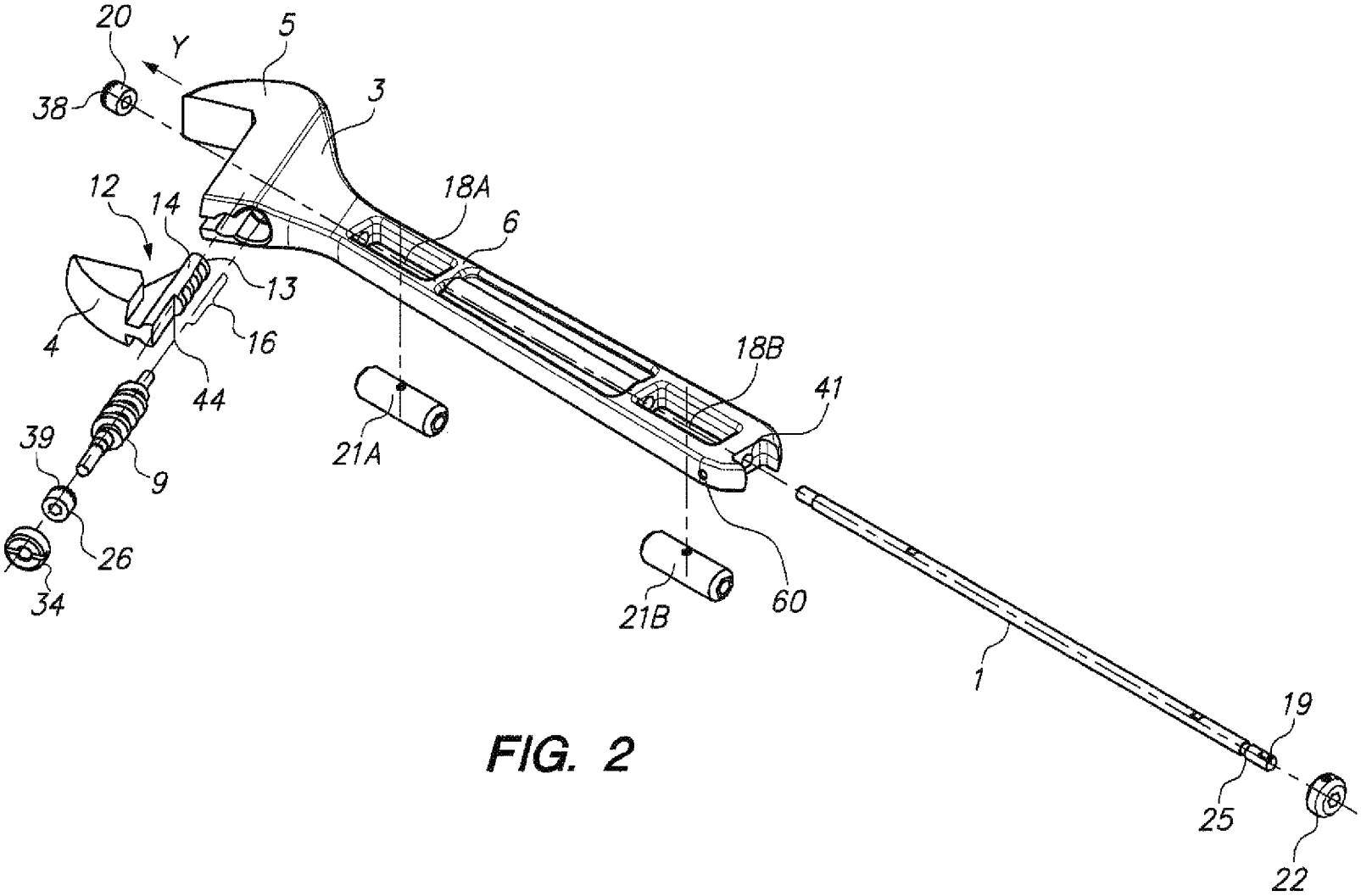
FIG. 2 shows an exploded view of the parts in the turn handle adjustable wrench.
Figure 3:
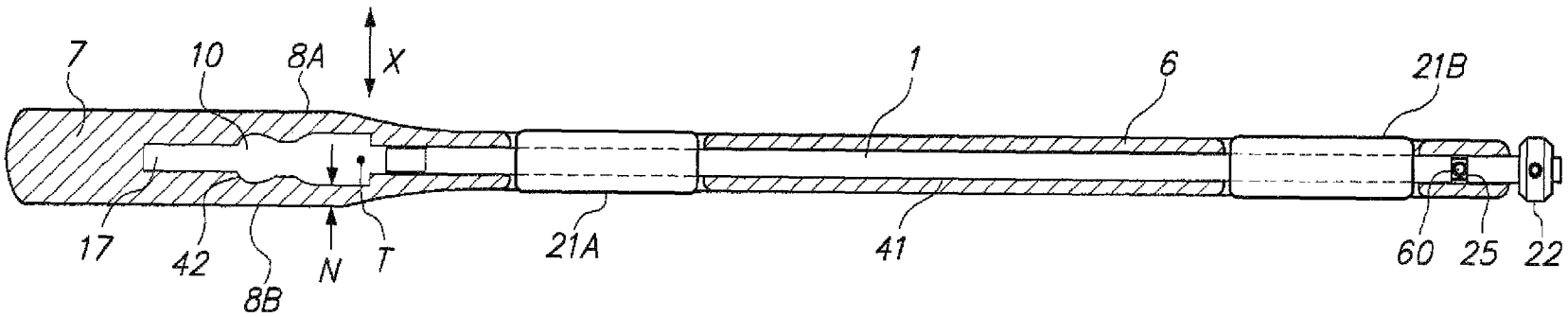
FIG. 3 shows the horizontal cross section (layered view) of the wrench of FIG. 1.
Figure 4:
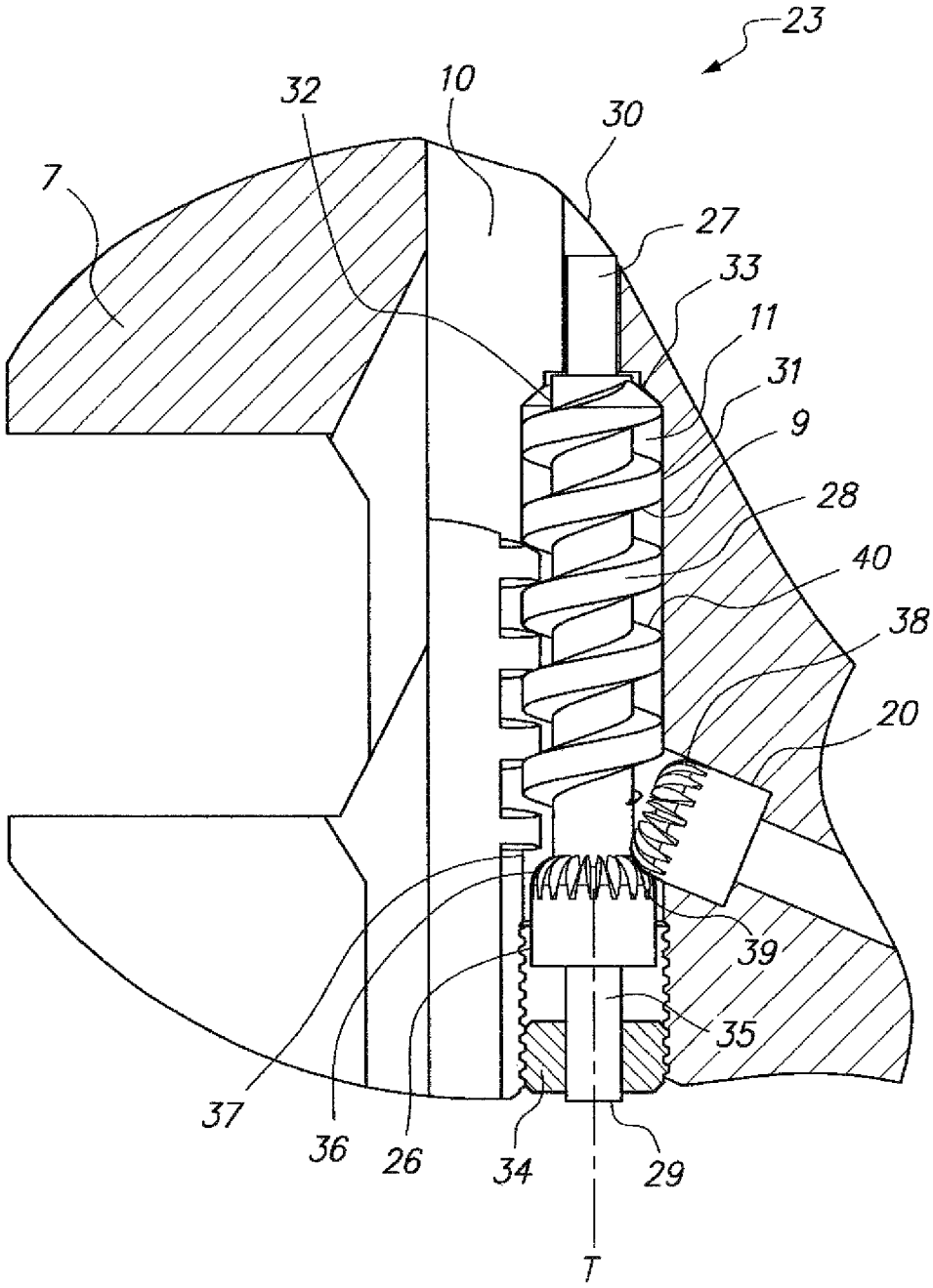
FIG. 4 shows a side view cross section (layered view) of the wrench of FIG. 1.

The adjustable wrench of the present invention employs a rotating rod 1. One embodiment of the wrench is shown in FIG. 1 indicated at 2. The wrench includes a wrench body 3 with a jaw 4 moveable mated thereto. The wrench body 3 includes a head section 5, a formed handle with cutout(s) 6, thru hole 41, and pinhole 60, which houses a rotating rod 1. The head section 5 includes a fixed jaw 7 that extends forward in direction X from one lateral side portion of the head section 5, and a pair of opposing sidewalls 8*a*, 8*b* that form a pair of recesses 11,10 that open to the other lateral side of the head section 5. As explained further below, the moveable jaw 4 and worm gear 9 are mated to the head section 5 via these recesses 11,10.

The moveable jaw 4 includes a conventional jaw body 12, an intermediate web 13, and a somewhat cylindrical lower portion 14. The jaw body 12 may be of a conventional type known in the art, typically with a planar jaw face 15. The jaw lower portion 14 includes a series of teeth commonly collectively referred to as a rack 16. The rack 16 is typically oriented in a direction that is perpendicular to the plane of the jaw face 15. The rack 16 is somewhat larger in cross section than the intermediate web 13, so that the jaw 4 can be mounted to the wrench body 3 by sliding web 13 through slot 17 discussed further below. The fixed jaw 7 and the moveable jaw 4 cooperate to form the working end of the wrench 2.

The handle 6 provides a convenient means to grip the wrench 2, and also houses the rotating rod 1. The handle 6 extends away from the head section 5 in direction Z, which may be parallel to direction Y or at an angle thereto. The handle 6 includes cutouts 18*a*, 18*b*. The cutouts 18*a*, 18*b* are generally rectangular oriented so that its long dimension is parallel to the handles 6 longitudinal axis M. The handle 6 has a thru hole 41 with a front slot recess 24. The thru hole 41 has a diameter slightly bigger than the rod 1. The rod 1 has a recess 25 at a specified distance from the rod's end 19. This recess 25 is aligned with the pinhole 60 in the handle 6. On the handle 6 is a pinhole 60 to accept a split drift pin to seat the rod 1 via the recess 25 aligned with the hole 60. The rotating rod 1 controls the positioning of the moveable jaw 4 relative to the fixed jaw 7. Broadly viewed, the rotating rod adjusting mechanism 1; having a recess 25 at a specified distance from rod's end 19, includes a rod bevel gear 20, rotating sleeves 21*a*, 21*b*, and an end knob 22. The rod 1 and a gear train 23 are operatively connecting the rod 1 to the moveable jaw 4. The rod 1 is rotatably mated to handle 6 and is disposed throughout the handle 6 inserted through the front slot recess 24 in direction Z until the rod's recess 25 aligns with the pin hole 60 in the handle 6. The sleeves 21*a*, 21*b* can be mounted in the cutouts 18*a*, 18*b* in the handle 6 simultaneously while inserting the rod 1 through the handle 6. The rod 1 can be seated with a pin through the hole 60 to meet the recess 25. Once the rod 1 is inserted through the handle 6 with the sleeves 21*a*, 21*b* then the end knob 22 can be applied. The gear train 23 converts rotational movement of the rod 1 into translational movement of the moveable jaw 4. The gear train 23, in one embodiment, includes three gears, the first of which rotates with the rod, and the last of which engages teeth on the moveable jaw 4 to cause the jaw 4 to move back and forth. For simplicity, these gears are referred to as rod bevel gear 20, worm bevel gear 26, and worm gear 9.

The worm gear 9 takes the form of an elongate body that is rotatably mounted in the wrench head section 5 with a seating portion 27, and a main portion 28, and a securing portion 29.

The seating portion 27 takes the form of a short longitudinally extending rod-shaped portion on one end and the worm gear 9. The seating portion 27 is intended to extend into a corresponding hole 30 in the main body of the wrench head section 5 to help locate the worm gear 9. The main portion 28 of worm gear 9 includes an external helical tooth 31 that directly engages the rack 16 on the moveable jaw 4 so that when the worm gear 9 turns about its rotational axis T, jaw 4 moves. The main portion 28 has a diameter larger than the seating portion 27, thus a shoulder is formed at the interface therebetween. If desired, a biasing element may press against the shoulder so as to urge the worm gear 9 in a direction along its rotational axis T, away from the fixed jaw 7. The biasing element 32 may take the form of a simple coil spring disposed about the seating portion 27 and captured between the head 5 and the shoulder 33, but any other biasing means known in the art may alternatively be used, including compressible washers, compressible foam, and the like. The securing portion 29 is disposed opposite the seating portion 27. The securing portion 29 takes the form of a short rod-like section that has a stepped-down diameter towards its distal end to form shoulder 33. The outermost portion of the securing section 29 extends into a corresponding portion of retaining cap 34 so as to be rotatably supported thereby. Worm bevel gear 26 is mounted on the securing portion 29, inboard of the retaining cap 34, so as to be rotationally coupled to the worm gear 9. The worm bevel gear 26 includes a central bore 35, through which the securing portion 29 extends. The central bore 35 includes an internal stepped section forming shoulder 36. It is intended that the securing portion's shoulder 37 will abut the bevel gears shoulder 36 so as to limit the relative movement of the worm bevel gear 26 toward the main portion 28 of the worm gear 9. Advantageously, the worm gear 9 is mounted so that its gear teeth 38 face inward towards the centerline of the wrench 2.

The rod bevel gear 20 is mounted to the forwardmost portion of the rod 1 so as to rotate therwith. The teeth 39 of the rod bevel gear 20 face forward, and engage corresponding teeth 38 on worm bevel gear 26. With this arrangement, rotational movement of the rod 1 causes rod bevel gear 20 to rotate, which causes worm bevel gear 26 to rotate, which causes worm gear 9 to rotate, which moves rack 16, which moves moveable jaw 4. Thus, the gear train 23 operatively couples rod 1 to moveable jaw 4.

Figure 5:
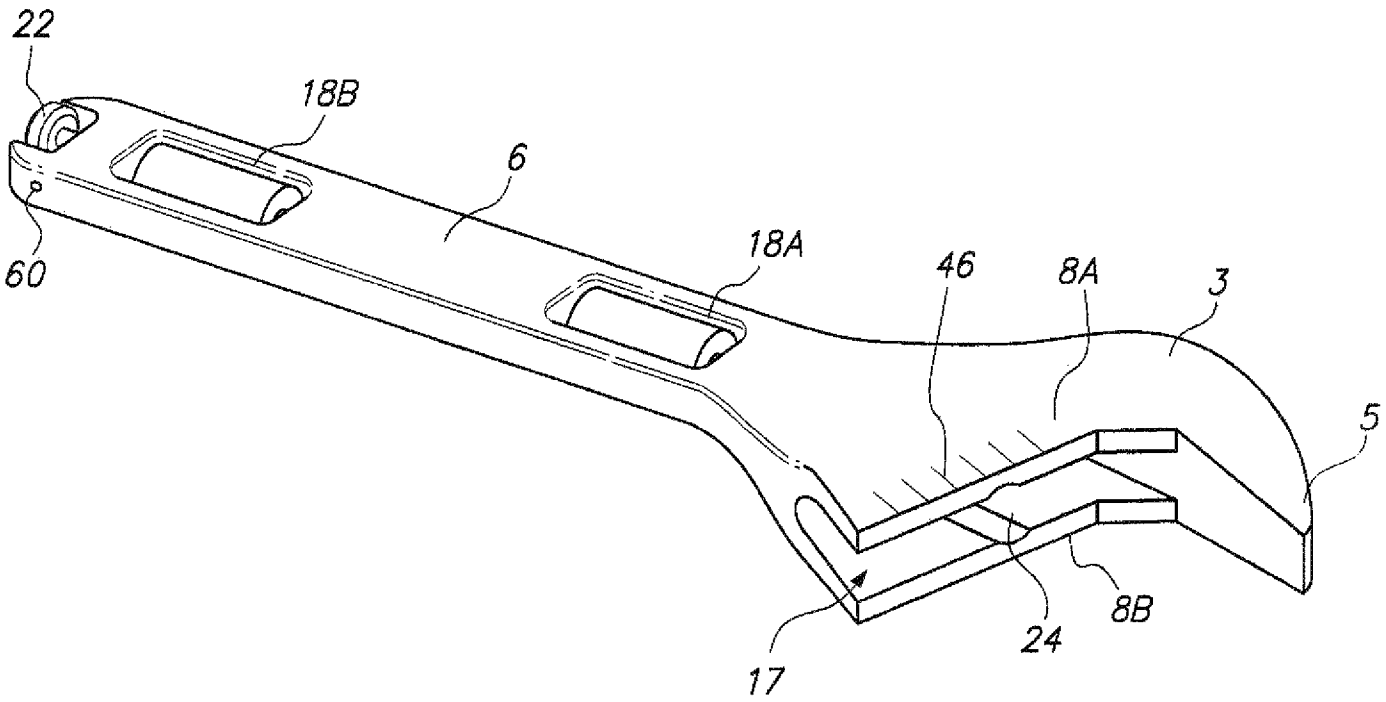
FIG. 5 shows an exploded view of the front head section.

As noted, worm gear 9 is mounted substantially inside head section 5 of wrench body 2. In order to accommodate this, the head section 5 includes a corresponding worm mounting recess 40. The worm mounting recess 40 may advantageously have a generally cylindrical cross section, centered on the worm gear rotational axis Y. One end of the recess 40 narrows, such as via a suitable taper, to form hole 30 for accepting the seating portion 27 of worm gear 9. The other end of recess 40 helps form opening. An internal passage connects worm mounting recess 40 to handle thru hole 41, with rod bevel gear 20 disposed in this internal passage. Head section 5 also includes another recess, known as the rack mounting recess 10, for accommodating rack 2 of the moveable jaw 4. The rack mounting recess 10 includes a forwardly open (i.e., opening generally in direction Y) slot 17 for accommodating moveable jaw web 13. Rack mounting recess 10 opens directly into worm mounting recess 40, so that rack 16 may engage worm tooth 31. Opening 42 is thus shaped somewhat like the numeral "8" with an upwardly extending center leg. See FIG. 5. The lower portion of opening 42 is centered about the worm gear's rotational axis Y. In operation, the movement of jaw 4 is controlled by the rotation of worm gear 9. However, unlike in conventional adjustable wrenches, the user does not directly turn the worm gear 9 to adjust the jaw spacing. Instead, the user adjusts the jaw spacing by turning/rotating the sleeve 21*a*, 21*b* or nipple 22 located on the handle 6. This movement causes the rod 1 to rotate, with this rotational movement transferred to the worm gear's rotational axis Y.

Many commercial adjustable wrench products are tested against the proof torque requirements of ASME B107.8, (2013). Some embodiments of the present invention incorporate various measures, which may be found alone or in combination, in order to be more robust so as to pass the proof torque requirements of ASME B107.8. One approach taken is to strengthen the sidewalls 8*a*, 8*b* proximate the worm mounting recess 11 so as to help keep the worm gear 9 in better contact with the moveable jaw's rack 16 during loading. To that end, the thickness N of the sidewalls 8*a*, 8*b* is increased in some embodiments. That is, if recess 11 centered about the worm gear's rotational axis T is considered to be a cylindrical bore with diameter E, then the wall thickness N of the proximate sidewalls 8*a*, 8*b* should each be about ¼ E or more. This distance is measured from the worm gear's rotational axis T and generally perpendicular to direction Y. This thickness N is believed to strengthen the sidewalls 8*a*, 8*b* against a spreading deflection outward away from each other (up/down in the view of FIG. 5); thereby maintaining the worm gear and the moveable jaw's rack 16 in proper engagement.

The wrench 9 may be assembled in a variety of ways. In one embodiment, a forged wrench body 3 is provided that includes the handle 6, the fixed jaw 7, the sidewalls 8*a*, 8*b*, etc. In addition, the rod bevel gear 20 is attached to the rod 1, such as by press fitting or pinning. The rod 1 is then fed through the front slot recess 24, through the handle thru hole 41 until the rod's recess 25 aligns with the pin hole 60 in the handle 6. During this process the sleeves 21*a*, 21*b* need to mount the rod 1 by placing the sleeve 21*a*, 21*b* in the cut out 18*a*, 18*b* in the handle 6 first, then extending the rod 1 in direction Z until the rod recess 25 aligns with the hole 60 in the handle 6. The pinhole 60 allows a pin to be inserted to meet the recess 25 which enables the rod bevel gear 20 and the worm bevel gear 26 to meet at the internal passage. The end knob 22 and sleeve 21*a*, 21*b* can then be secured by being glued or pinned. Worm bevel gear 26 is joined to (e.g., press fit onto) securing portion 29 of worm gear 9. Optional bias spring 32 is placed around seating section 27, rack 16 and worm gear 9 inter-engaged, and worm gear 9 inserted into worm mounting recess 11 and rack 16 inserted into rack mounting recess 10 with web 13 of moveable jaw 4 inserted into slot 17. The retainer cap 34 is then loosely screwed into wrench body 3 to retain worm gear 9. The retaining cap 34 is then tightened and secured in place, such as by staking or glue.

The various components of the wrench may be made from any suitable materials known in the art, such as hardened steel, reinforced plastics, and the like. The external portions of the wrench may be nickel chrome plated, or otherwise treated for a desired appearance. The gears, 26, 20 may be metal injection molded if desired with a hardness of 35-40 Rockwell C.

The worm gear 9 should formed of a suitably hard material to withstand the interactions with the teeth 44 of rack 16 under load, such as by having a hardness of about 41-47 Rockwell C, with the teeth 44 having a hardness of about 43-47 Rockwell C. Note that the rack 16 of moveable jaw 4 may be shorter in length than the conventional adjustable wrenches so as to allow portions of the moveable jaw 4 to traverse beyond gear 26 for greater adjustability. Further, in some embodiments, the wrench 2 may optionally include one or more scales 47 that indicate the spacing between the jaws. A portion of such scale 47 can also be on the wrench body 3, with an indicator 46 printed or etched on moveable jaws. One scale 47 may be in "English" units on one face of the wrench 2 and another scale 47 may be in metric units on the opposing face of the wrench 2.

The present invention may, of course, be carried out in specific ways than those herein set forth without departing from the essential characteristics of the invention. The present embodiments are, therefore, to be considered in all respects as illustrative and not restrictive, and all changes coming within the meaning and equivalency range of the appended claims are intended to be embraced therein.

The invention claimed is:

1. An adjustable wrench, comprising; a head having a first fixed jaw; a handle extending away from said head and having a longitudinal axis; a second jaw selectively positionable with respect to said first jaw; a rotating rod controlling the positioning of said second jaw and comprising first and second rotating sleeves; the first sleeve located in a first cutout of said handle in a first portion of the handle adjacent to the head; the second sleeve located in a second cutout of said handle in a second portion of the handle distal from the head; a gear train operatively coupling said rod to said second jaw; an end knob on the end of the rod opposite from said gear train; said respective rotating sleeves and said end knob secured for rotation with said rod.

2. The adjustable wrench in claim 1 wherein the rotating sleeves are disposed between said rods end and said gear train.

3. The adjustable wrench of claim 1 wherein said gear train comprises a rotatable worm gear operatively disposed between said rod and said second jaw.

4. The adjustable wrench of claim 3 further comprising a biasing member biasing said worm gear towards said rod.

5. The adjustable wrench of claim 4 where said biasing member comprises a spring.

6. The adjustable wrench of claim 3 further comprising a retaining cap disposed to constrain axial movement of said worm gear.

7. The adjustable wrench of claim 1 wherein said first jaw extends in a first fixed direction generally opposite said handle; wherein said head further comprises a pair of spaced, generally parallel, sidewalls extending from said first jaw; further comprising a recess defined between said sidewalls; wherein said gear train comprises a worm gear disposed substantially within said recess and having a rotating axis; said recess having cross-sectional dimension E measured in direction X that is both normal to said rotational axis and generally perpendicular to said first direction; wherein said sidewalls both have a thickness in direction X of 25% E or more.

8. The adjustable wrench of claim 1 wherein the rotating sleeve(s) are disposed between the rods end and the gear train.

9. The adjustable wrench in claim 1, wherein the rod includes three holes therein to receive split pins for fixing the respective sleeves and the end knob to the rod.

10. The adjustable wrench in claim 1, wherein the sleeves and the end knob are fixedly secured to the rod by adhesive.

11. The adjustable wrench in claim 1, wherein the rod includes a reduced diameter at a predetermined distance from an end of the rod for receiving a pin secured in the handle to secure the rod axially within the handle.

12. The adjustable wrench in claim 1, wherein said end knob is rotatably secured to the rod by a split drift pin or adhesive.

* * * * *